US007503153B2

(12) United States Patent
De Matteis

(10) Patent No.: US 7,503,153 B2
(45) Date of Patent: Mar. 17, 2009

(54) PAPER FEEDING DEVICE FOR A BANDING MACHINE FOR LOGS OF SHEET MATERIAL

(75) Inventor: Alessandro De Matteis, Lucca (IT)

(73) Assignee: MTC-Machine Trasformazione Carta S.R.L., Porcari (IT)

( * ) Notice: Subject to any disclaimer, the term of this patent is extended or adjusted under 35 U.S.C. 154(b) by 0 days.

(21) Appl. No.: 11/743,843

(22) Filed: May 3, 2007

(65) Prior Publication Data

US 2007/0272788 A1 Nov. 29, 2007

(30) Foreign Application Priority Data

May 26, 2006 (EP) ..... 06010818

(51) Int. Cl.
*B65B 11/06* (2006.01)
*B65B 41/00* (2006.01)

(52) U.S. Cl. ..... 53/230; 53/228; 53/223

(58) Field of Classification Search ..... 53/586, 53/220, 221, 223, 228, 230
See application file for complete search history.

(56) References Cited

U.S. PATENT DOCUMENTS 2,700,459 A * 1/1955 Anspacher ..... 206/326
3,385,026 A * 5/1968 Schmermund ..... 53/228
3,648,431 A * 3/1972 Hartbauer et al. ..... 53/528
3,841,057 A * 10/1974 Engeler ..... 53/389.3
3,946,539 A 3/1976 Noack
3,982,375 A * 9/1976 Focke ..... 53/466
3,991,542 A * 11/1976 White et al. ..... 53/586
3,996,728 A * 12/1976 Gentili ..... 53/389.3
4,167,841 A * 9/1979 Camp ..... 53/399
4,386,997 A 6/1983 Molitor et al.
4,509,314 A 4/1985 Bozza
5,133,173 A * 7/1992 Draghetti et al. ..... 53/466
5,189,864 A * 3/1993 Cinotti et al. ..... 53/439
5,249,408 A * 10/1993 Winnemoller et al. ..... 53/439
5,437,142 A * 8/1995 Akiyama et al. ..... 53/415
5,797,247 A * 8/1998 Nakagoshi et al. ..... 53/442
6,223,500 B1 * 5/2001 Kramps ..... 53/399
6,318,053 B1 * 11/2001 Frank et al. ..... 53/586
6,370,845 B1 * 4/2002 Kokkersvold et al. ..... 53/452
6,481,186 B2 * 11/2002 Kokkersvold et al. ..... 53/447
6,640,522 B2 * 11/2003 Antoniazzi et al. ..... 53/466

(Continued)

FOREIGN PATENT DOCUMENTS

WO 2004099929 A2 11/2004

*Primary Examiner*—Paul R Durand
(74) *Attorney, Agent, or Firm*—Dennison, Schultz & MacDonald

(57) ABSTRACT

Banding machine for packaging logs of stacks of folded, overlapped or interfolded sheets applies a banding web of paper or plastic film on four longitudinal sides. During motion of the web in a direction orthogonal to the drawings, a glue gun spreads a glue line the length of the web, near the lower free wing. The packaging web crosses the walls at upper and lower gaps. Pushing the compressed log in the channel, the packaging web is arranged stretched in front of the log, the log being pushed against the packaging web well beyond the gap, causing self-packaging, i.e. the log is wound for ¾ by the web, leaving two free wings with the second having glue on it. At least one of the sections includes a movable portion, which can be a rotating wall, for enlarging the gap to allow the movement of the glued zone of the web.

12 Claims, 9 Drawing Sheets

U.S. PATENT DOCUMENTS 6,658,819 B2 * 12/2003 Gamberini ..... 53/436
6,865,861 B2 3/2005 White
6,880,313 B1 4/2005 Gessford

* cited by examiner

PAPER FEEDING DEVICE FOR A BANDING MACHINE FOR LOGS OF SHEET MATERIAL

FIELD OF THE INVENTION

The present invention relates to the production of stacks of paper material, and, in particular, it relates to a banding machine for logs of folded, overlapped or interfolded material, for arranging around a log a tubular wrapper of paper and the like.

BACKGROUND OF THE INVENTION

As well known, in the paper converting industry a variety of types is used of machines and of processes for making paper tissues, paper towels and similar articles in stacks of interfolded sheets of a certain height.

The stacks are obtained folding the sheets and simply overlapping them on one another or interfolding them, i.e. at each fold a wing of the previous sheet and a wing of a next sheet of the stack engage with each other. This way, when drawing a sheet from a package, at the moment of the use, also a wing of a next sheet of the stack is dragged up to protruding from the package, with subsequent practical utilization for certain types of users. Among possible interfolding ways the L-type, with 2 folds (single fold), or the Z or W types, respectively with 3 and 4 folds (multi fold), are known.

After a step of separation of a pack from the stack, once achieved a measured height of the pack, a step follows of conveying the packs or logs for following treatment and packaging.

The stacks of folded or interfolded sheets from which a log is formed have a length that depends on the width of the starting web, normally about 2 metres and more.

For example, in case of logs of interfolded products exiting from the head of an interfolding machine, according to the type of interfolded product and then to the final use, said log can be conveyed to a transversal cutting machine forming small packages of predetermined length and then forwarding them to a binder that puts them in wrappers tailored for the users. With this solution, normally, the so-called "facial tissue" products are packaged.

Alternatively, the products can be distributed as banded packs or clips, as is the case of "hand towels", which can be put in special fixed distributors with standard shape. In this case, the whole log of interfolded product, normally, is at first compressed and then banded by a web that covers it around, creating a tubular wrapper. The banded log is then cut off into single small packages or clips that are already banded by a corresponding cut tubular wrapper portion.

In the latter case, for carrying out the banding step, banding machines are used located downstream of the interfolding machine. In particular, the log of interfolded sheets produced and exiting from the interfolding machine can be carried directly into the banding machine by means of an appropriate conveying system. The log moves towards the banding machine travelling on a conveyor belt. A known system of this type is for example described in U.S. Pat. No. 6,865,861.

At the entrance in the banding machine the log meets a portion of path set between two overlapped conveyor belts that gradually decrease their relative distance in the vertical direction in order to compress the log. Once ended the compression step or contemporaneously with it, the banding is carried out by means of a packaging sheet unwound from a web, as described in U.S. Pat. No. 6,865,861.

In other solutions, instead, there is a movable upper support that compresses the log transported by the lower conveyor belt at a compressing position, reaching the same object of pressing the material of the log and of reducing its height before packaging. For example, a machine of this type is described in EP1636093.

Once the log has been conveyed completely in the machine a pusher brings it forward against a packaging sheet stretched along all the length of the machine. The packaging sheet can be of different material and in any case is automatically unwound from a roll and stretched in front of the log as an obstacle. Owing to the pusher that pushes the log against the stretched sheet a kind of self-packaging is carried out, i.e. the log is wound by the sheet for ¾ of its longitudinal sides.

A step follows of closing the packages by glueing. In particular, in one of the possible configurations of the state of the art, the roll from which the packaging web is unwound can be arranged in line to the banding machine by means of a special unwinder. The packaging web is located in stretched position in front of the log by pulling means. Then the log is pushed horizontally by a pusher in a zone between fixed upper and a lower plates meeting said paper in order to cross it and to allow it to band the log on three sides. In this case, being the unwinder of the paper located in line with the banding machine, the glue is spread only after banding the log with the packaging web for ¾. In this way glue is distributed along all the length of the upper wing of the web. Then, plates that move adjacent to the log close the wings. The banded log are pushed forward against one another exiting from the channel defined by the two fixed plates. The pushing actions in turn of the other packages assist the compression of the glued wings and thus the closure of the package.

Alternatively, it is possible to feed the paper horizontally, i.e. longitudinally with respect to the log. These solutions where unwinding the paper is carried out laterally, are more technologically advanced. In this case a single fixed glue gun is enough for the distribution of the glue when unwinding the paper along all the width of the banding machine. The paper is unwound by means of two couples of belts (an upper and a lower couple) that grip the paper and pull it for all the width of the banding machine. Said structural simplification provided by this solution requires however other structural complications and limits. In fact, the use of a single fixed glue gun (normally located between the paper path and the lower plates), allows a distribution of the glue when moving the paper in front of the log and then before the banding for ¾ of the lateral sides as described in the previous solution. This causes a loss of glue previously spread along the length of the paper being unwound when the paper is wrapped around the log during the packaging steps, in particular, in the motion through a narrow gap through which the paper moves pulled by the belts through the plates that form the introduction channel.

In order to solve this problem, in the prior art, a translatable drawing mechanism is provided. In this way, once wrapped the log by completion of the pushing action against the web, this drawing mechanism withdraws creating automatically an upper gap to prevent glue from adhering to mechanical parts of the machine.

Since the drawing mechanism engages with the log after that it has been wrapped around three sides, this prevents that the glue spread along the length of the paper dirties the components of the machine, and, in particular, the upper or lower plates, and that the film of glue is spoiled, causing a faulty adhesion of the two wings on the fourth side.

The use of the drawing mechanism, however, is a considerable structural complication. In fact, in addition to higher costs for making the machine, it causes a limitation on the maximum width of the machine, since a drawing mechanism too long would have problems for low stiffness. Furthermore, it requires a strong limitation to productivity necessary to the drawing mechanism for withdrawing and allowing the following closure of the wings.

On the other hand, the removal of the drawing mechanism has the problem of the glue dirty caused by the motion of the glued paper between the plates.

SUMMARY OF THE INVENTION

It is therefore a feature of the present invention to provide a structure of banding machine for logs of overlapped, folded or interfolded sheet material, which does not use the drawing mechanism, simplifying thus remarkably the construction of the machine same.

It is a particular feature of the invention to provide a structure of banding machine without drawing mechanism that has not problems of dirtying by the glue.

These and other objects are accomplished by the structure of banding machine, according to the present invention, for banding a log of sheet material with a packaging sheet comprising:

a packaging channel, consisting of a first and a second consecutive sections, between said first and second sections being present a narrow gap;

pushing means adapted to convey a compressed log in said channel, said log under the action of said pushing means entering said first section and then running in said second section up to a depth predetermined;

means for arranging a packaging web for said log between said first and said second section running through said gap, whereby said web wraps on three sides said log that moves in said channel moving from said first to said second section, on said web being applied, before pushing said log, a film of glue in a predetermined zone;

characterized in that least one between said first and said second section comprises a movable portion for enlarging said gap at the passage of said glued zone of said web.

Preferably said channel comprises:

at least two lower plates adjacent and distanced by said gap, said lower plates being located one in a front position and one in a rear position with respect to each other in a way suitable to form a support/sliding plane for said log, and at least two upper plates adjacent and distanced by said gap, located one in a front position and one in a rear position with respect to each other and in a way suitable to form a upper plane for containing said log wherein said first section comprises said front plates and said second section comprises said rear plates, at least one of said plates of said sections being movable for enlarging said gap.

Preferably, for enlarging said gap said front lower plate is movable. In particular, said front lower plate is mounted in a rotatable way.

In addition, or alternatively, to the front lower plate at least one portion of the rear section can be movable with respect to the front section.

Advantageously said means for arranging a packaging web have at least two couples of pulling belts, of which one couple located in a position higher than said upper plates and a couple located in a position lower than said lower plates and allowing the motion of the packaging web in said gap to be arranged for all the width of the machine to allow then banding of the log.

Furthermore, between each couple of belts and the channel a vertical guide can be provided adapted to carry the web towards the means for packaging. In particular, the guide comprises suction holes, connected to a vacuum system, in order to keep the web adhesive to the surface of the guide same.

Advantageously the means adapted to packaging the log comprises at least one system of glue distribution adapted to spread an amount of glue along a line of the web of paper and located in a position set between said plates and said belts, said means for distribution of the glue along a line of the paper comprises a fixed glue gun located distanced between the lower couple of pulling belts of the web and said lower plates.

Advantageously said front plate of said couple of lower plates has a rotatable motion in order to increase the size of the gap of passage of the web of paper with glue spread along a line in its lower part.

Advantageously means are provided for closing the two free wings of the web wound about the log, comprising an upper sheet laying member having vertical movement located aligned with said log in a way suitable for stretching a first free wing of web on said log and a lower plate located also aligned with said log and movable in a way suitable to lay said free wing with glue on said free wing without glue.

Advantageously said lower plate has vacuum suction holes connected to a suction system, in order to keep the sheet adhesive during its lowering movement below the level of the lower plates for allowing the back stroke of the piston without that the latter is dirtied with glue spread on the web.

Preferably, the lower plate is associated to auxiliary folding means adapted to overlapping a free wing of the web on the other free wing for allowing a mutual glueing.

BRIEF DESCRIPTION OF THE DRAWINGS

Further characteristics and the advantages of the banding machine, according to the invention, will be made clearer with the following description of an exemplary embodiment thereof, exemplifying but not limitative, with reference to the attached drawings, in which like reference characters designate the same or similar parts, throughout the figures of which.

Figure 1:
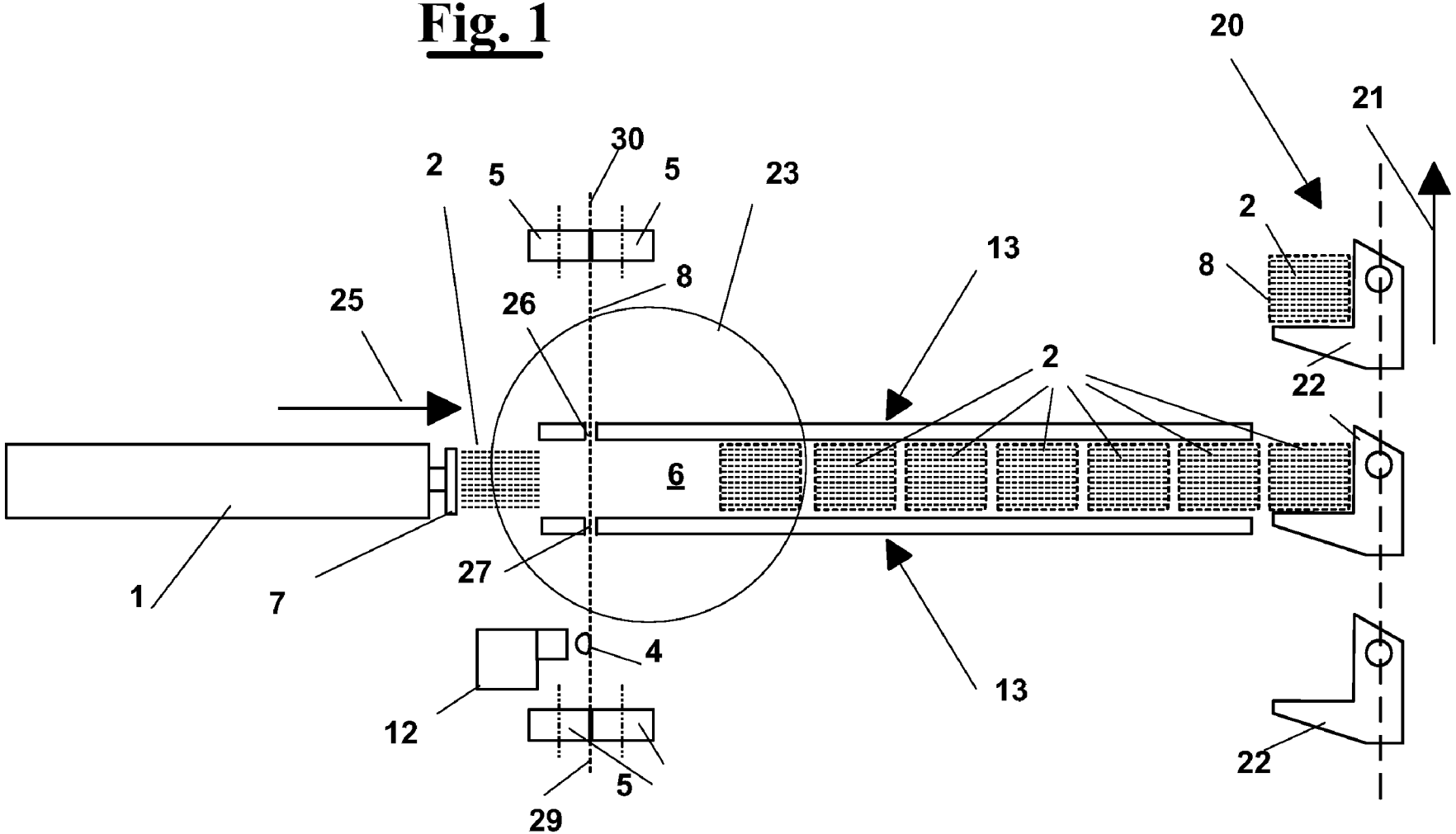
FIG. 1 shows a banding machine for logs of overlapped, folded or interfolded sheet material, provided with a banding system not shown in detail and located in the zone indicated by a thin line circle.

FIGS. from 2 to 9 show diagrammatically the banding machine of FIG. 1 in various steps of operation;

FIGS. from 10 to the 16 show diagrammatically an exemplary embodiment of the banding machine of FIG. 1 in various steps of operation.

DESCRIPTION OF A PREFERRED EXEMPLARY EMBODIMENT

With reference to FIG. 1, a banding machine for packaging a log 2 consisting of stacks of folded, overlapped or interfolded sheets, is adapted to apply a banding web of paper or plastic film 8 for banding it on four longitudinal sides, through means for packaging 23 indicated generically as a zone in a thin line circle and shown hereinafter.

As shown in FIG. 1, the log 2 arrives in front of a pusher 7 operated by an actuator 1, in an already compressed shape, i.e. as a compact stack of longitudinal sheets. The way with which the log 2 comes in front of a pusher 7 is not described in detail. For example it can be used a system of known type, as described in U.S. Pat. No. 6,865,861, or in a way described in a european patent application in the name of the same owner of the present application and filed on the same day.

The packaging web 8 is unwound from a roll not shown in a direction perpendicular to the sheet of the drawings. For unwinding the web 8 an unwinding system provides upper and lower belts 5 coupled in pairs that operate in the plane of the web 8 and unwind it from a roll not shown. The length of the machine, not shown in a direction parallel to the log, i.e. in the direction orthogonal to the drawings, can be also of two—three metres or more, and can be exploited for treating a single log 2 at a time or more shorter logs and aligned to each other. More precisely, a glue gun 12, during the motion of the web in a direction orthogonal to the drawings, spreads a glue line 4 for all the length of the web 8, near the lower free wing 29.

The banding by the packaging web 8 is carried out in a known way by moving an actuator 1 that operates pusher 7, which pushes log 2 in a direction 25 into a channel 6 defined by walls 13. The packaging web 8 crosses the walls 13 at two gaps 26 and 27, respectively upper and lower gaps. This way, pushing the log 2 compressed in the channel 6, the packaging web 8 is arranged stretched in front of the log 2 as an obstacle along all the length of the machine. Thus, by pusher 7, the log 2 is pushed against the packaging web 8 well beyond the gap 26 and 27, causing a kind of self-packaging, i.e. the log is wound for ¾ by the web 8 leaving two free wings, 29 and 30, of which the second having a line of glue.

Then, after the withdrawal of pusher 7, the means for packaging 23, in a way shown hereinafter, with a system of transversal plates, lay wings 29 and 30, so that they are closed on the free side of the log 2. Finally, as compressed logs 2 are banded, they are pushed in channel 6 up to an outlet where they are drawn by a conveyor belt.

In detail, the features are now described of the means for packaging 23 of the machine according to the invention and the various operative steps.

Figure 2:
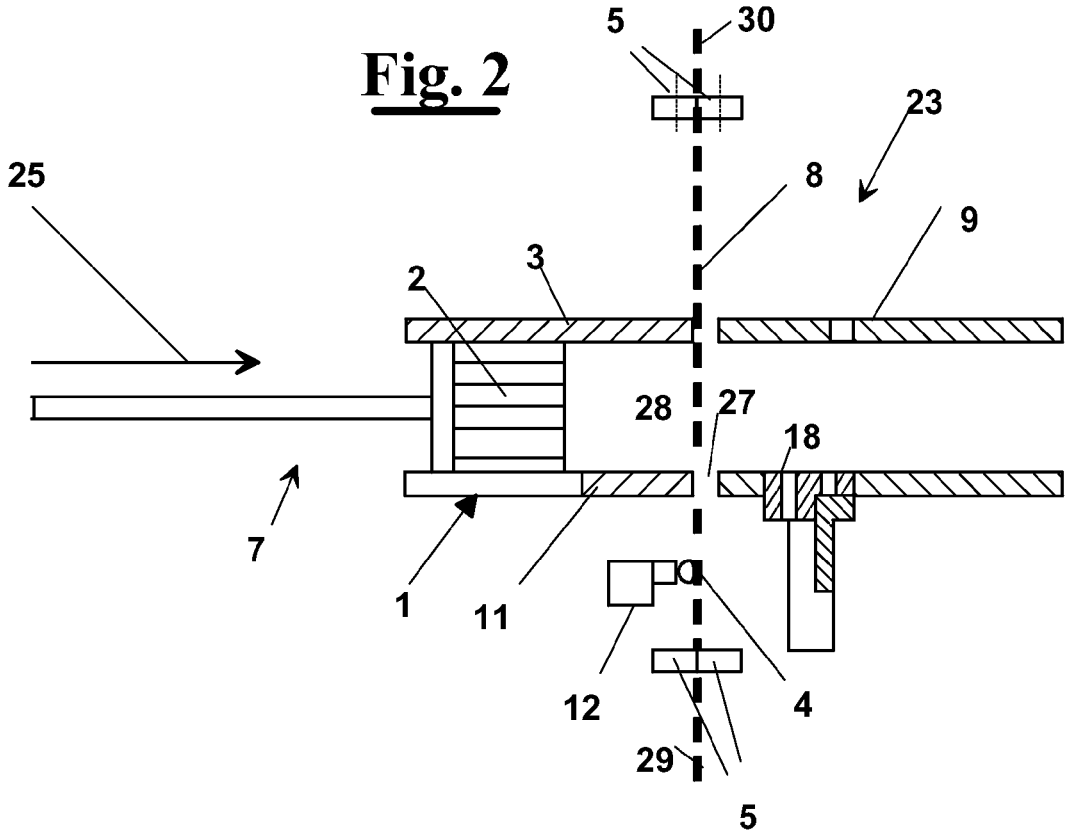

With reference to FIG. 2, the means for packaging 23 comprises channel 6 defined by the two upper and lower walls 13 that consist of two upper plates, of which a front upper plate 3 and a rear upper plate 9, as well as two lower plates, of which a front lower plate 11 and a rear lower plate 10. The front plates and the rear plates, respectively upper and lower are separated by gaps 26 and 27, which in the following figures are indicated enlarged to enhance the understanding of the present description.

The compressed log 2, as above described already, is located at first in front of pusher 7, compressed between a portion of the front upper plate 3 and a platform located underneath, for example a mobile platform. Pusher 7 is ready to start moving in the direction of arrow 25. Pusher 7 is capable of pushing the log 2 as shown against packaging web 8, stretched along all the width of the banding machine, causing a self-packaging of the log 2.

Figure 3:
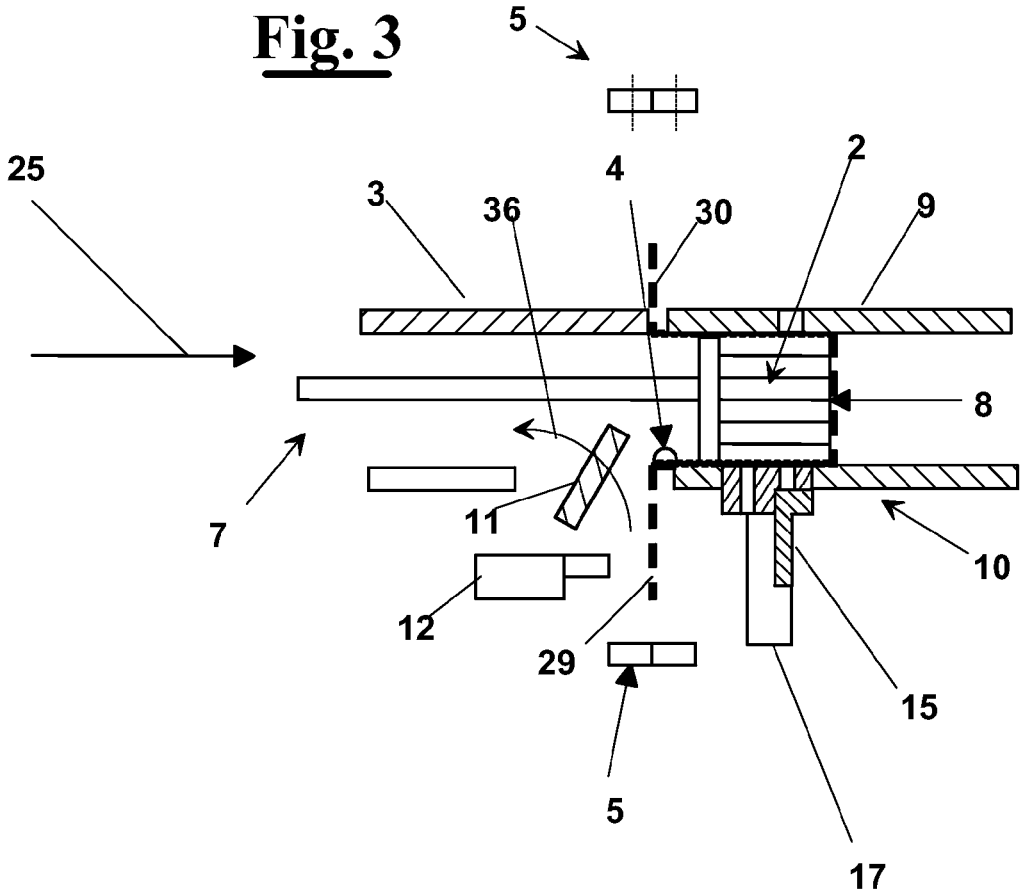

At the end of the stroke of pusher 7, as shown in FIG. 3, the log 2 is wound by said packaging web 8 for ¾ of its longitudinal sides, except from the part that contacts pusher 7. As shown, always according to FIG. 3, the log 2 moves in the channel 6 against packaging web 8, leaving free only the two wings 29 and 30, which are then closed on each other for completing the packaging.

Free wings 29 and 30, are not yet passed through gaps 26 and 27, which are of minimum size, such that only the motion of the packaging web 8 is allowed, to avoid undesired movement during its introduction. In particular, the lines of glue 4 must pass through the gap 27, with the problem of dirtying the front lower plate 11 with glue. This would cause both a bad distribution of the glue on the free wing 29 with subsequent bad quality of the final packaging, and a risk of obstruction of said gap 27, as well as dirtying piston 8.

According to a preferred exemplary embodiment of the invention, means are provided that rotate the front lower plate 11 according to the direction of arrow 36. This system allows creating a larger gap 27 to allow the motion of the glue line 4 without the problem of dirtying parts of the machine.

Obviously, this rotation of the front lower plate 11 is only one of the possible solutions to the inventive concept, and still another desired movement for making a larger gap can be used, such as a lateral translation. Furthermore, the same system can be mounted on the upper plate of said front section with respect to the rear section, and then positioning the glue gun in the upper part of the machine.

Figure 4:
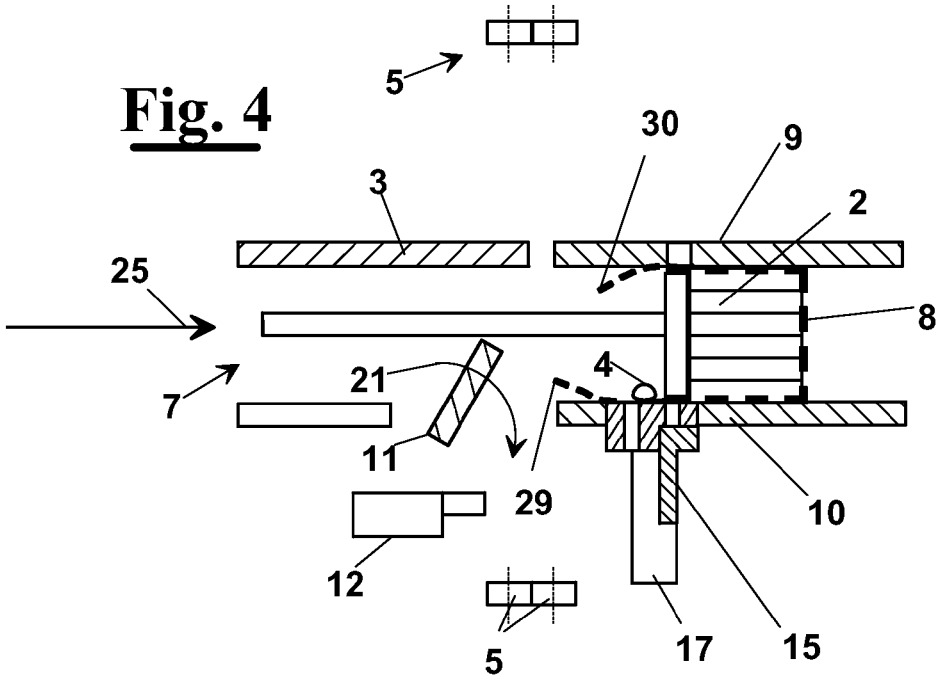

As shown in FIG. 4, then, front plate 11, immediately after the motion of the glue line 4, moves back to the starting position by means for a counter-rotation indicated by means of arrow 21 for then allowing pusher 7 to withdraw to the starting position.

Before that pusher 7 carries out this movement it is necessary to avoid that, during said back movement, pusher 7 finds immediately behind itself the glue line 4 spread on free wing 29. In fact, during said back movement pusher 7 would cause a scattering of glue 4 with subsequent problems of bad quality of the final package and further problems of quality owing to the glue that would dirty the pusher.

A possible solution can be to raise the pusher, or to avoid that it moves along lower plate 10.

Figure 5:
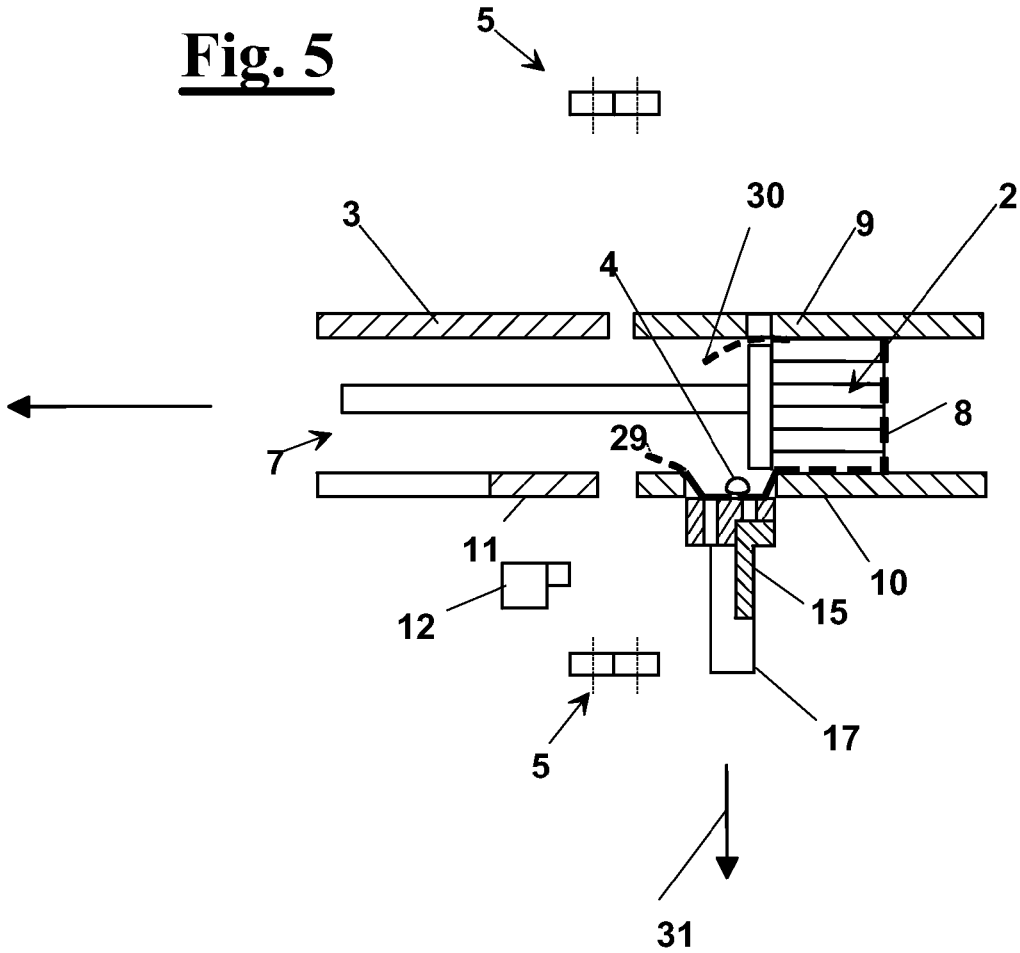

In a preferred exemplary embodiment, as shown in FIG. 5, a device is provided for lowering/lifting 17 a portion 31 of the rear lower plate 10 arranged on its contact surface with the free wing 29 of vacuum suction holes 18. In this way, owing to suction of air through holes 18, in the lowering movement of the portion of surface 31 by the actuator 17, the free wing 29 is dragged towards below integrally to the glue line 4, as indicated by the arrow 33. This creates the space necessary for moving pusher 7 in its motion of back stroke without touching the glue 4.

After the withdrawal of pusher 7 the closing of the wings 29 and 30 is carried out as shown in FIGS. 6, 7, 8 and 9.

Figure 6:
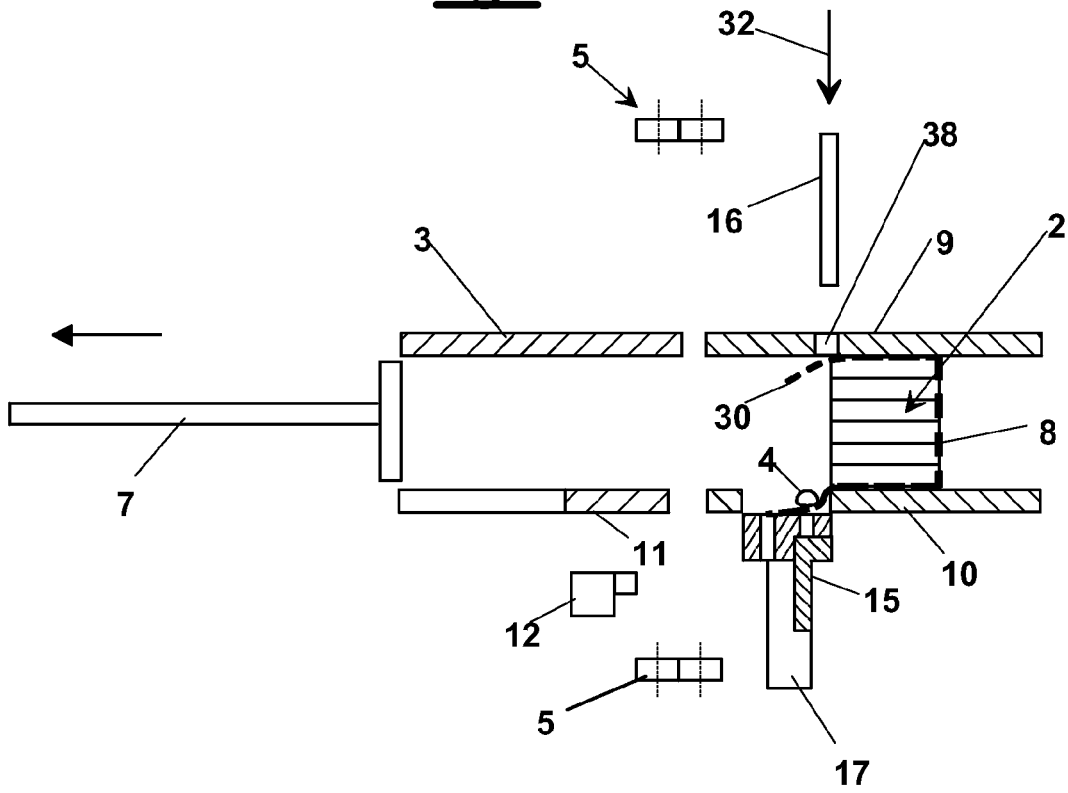
Figure 7:
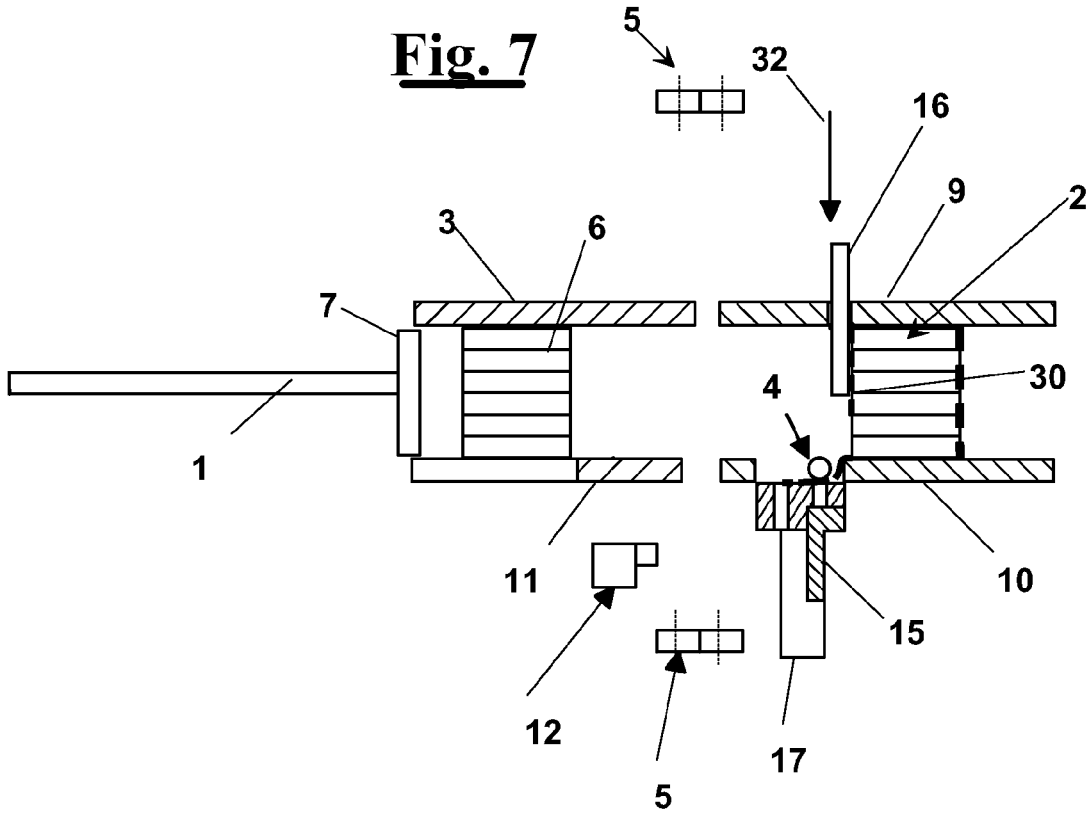

More precisely, as shown in FIG. 6, an upper sheet laying member 16 is provided arranged aligned with respect to the edge front of log 2. The sheet laying member 16 is ready to be lowered according to the direction of the arrow 32 through a slit 38 made of the upper plate rear 9. In this way it is possible to stop the first free wing 30 of paper on the free side of the log 2 in the banding machine. Then, the sheet laying member 16 has a quick back stroke to the starting position (FIG. 7).

Figure 8:
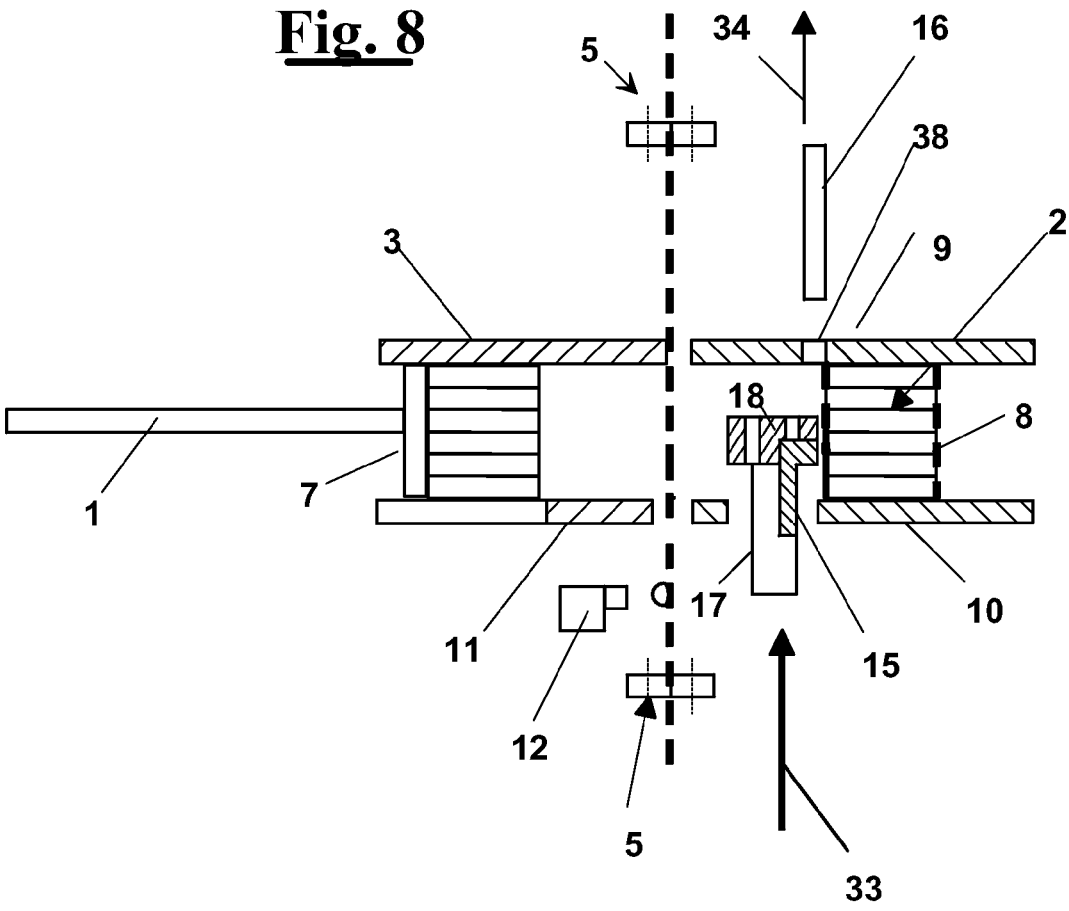

In the meantime, as shown in FIG. 8, the closing of wing 29 is carried out, on which glue line 4 is present, on the wing 30 without glue that is already aligned with the log 2. The piston 17, in fact, during its lifting motion towards the above engages with said free wing of paper 29 and causes the latter to close on that located underneath 30 without glue.

Figure 9:
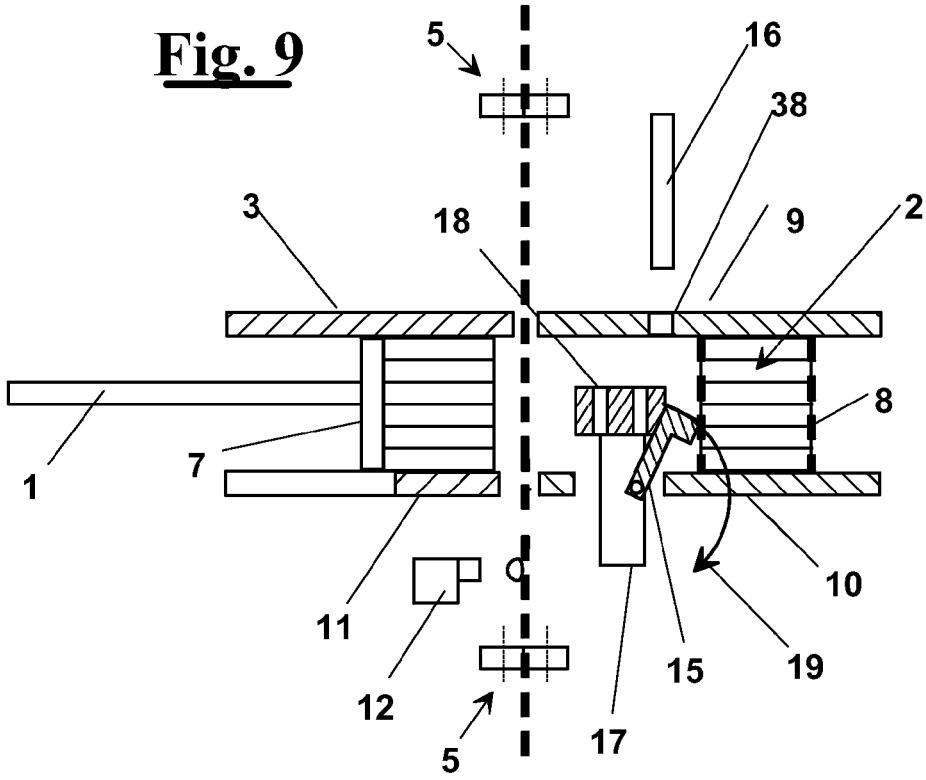
Figure 10:
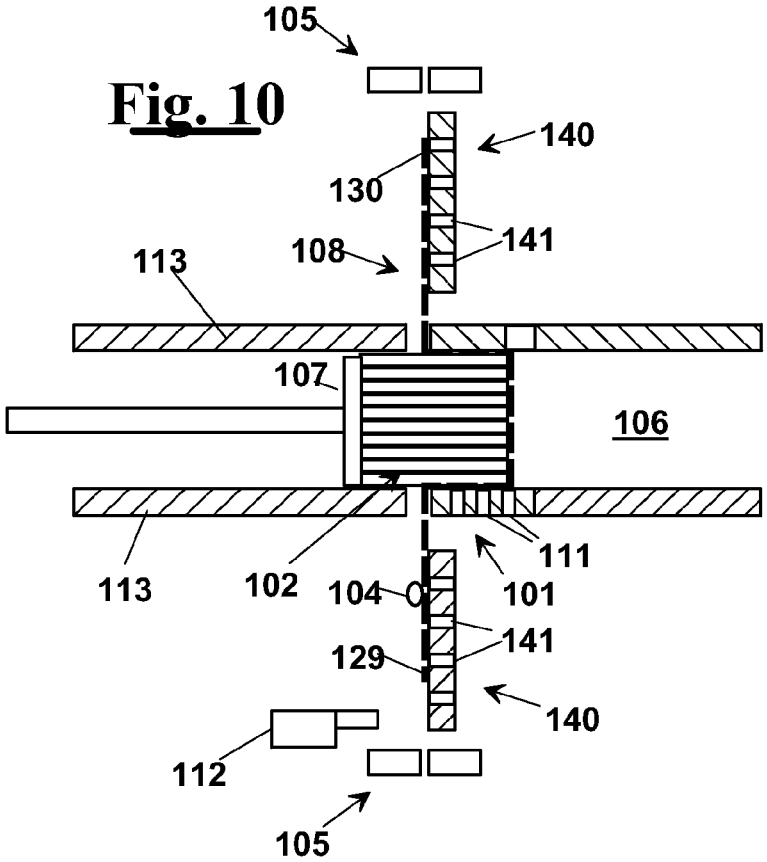
Figure 11:
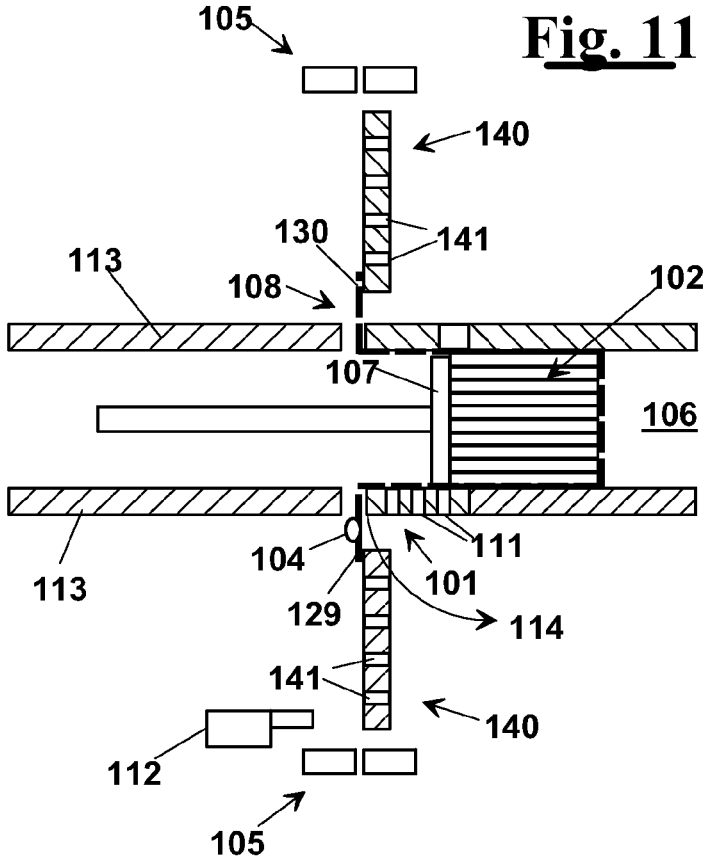

A following step of the wing closing phase is shown in FIG. 9, where a lever device 15 is provided that rotates in the direction of log 2 according to arrow 19 causing a further pressure on the paper. This further pressure ensures a better grip of the wing 29 with glue on that 30 without glue and then a better closing.

With a rotation not shown opposite to arrow 19, finally a motion of piston 17 follows back to the starting position in order to receive the next log 2, again as shown in FIG. 2. In fact, as shown in FIGS. 6-9 contemporaneously to closing wings 29 and 30 a log 2 (FIG. 7) is arrived in front of pusher 7 which begins to push (FIGS. 8 and 9) it in channel 6.

Figure 12:
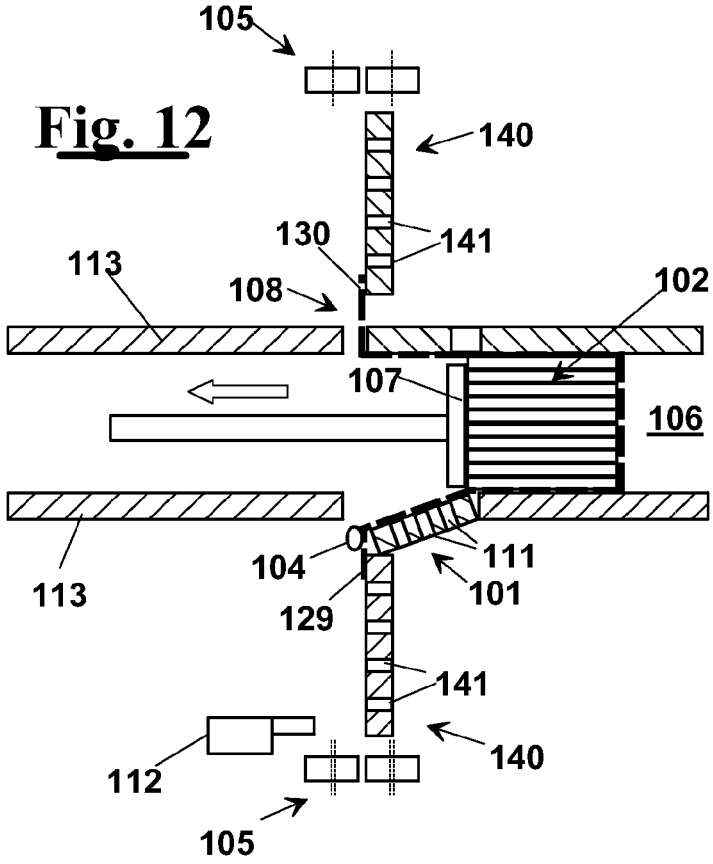
Figure 13:
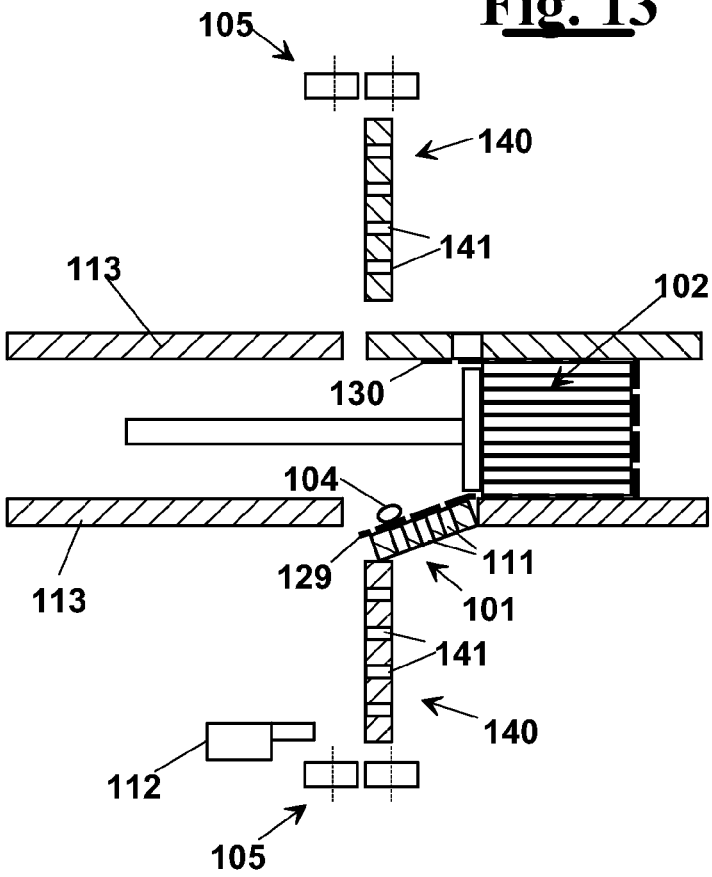

In an exemplary embodiment of the invention, shown in figures from 10 to 16, at least one part of the second section is movable. In particular, plate 101 can rotate as indicated by arrow 114 about an axis orthogonal to the conveying direction of log 102 (FIG. 12) increasing therefore the gap 127 through which web 108 can move.

Like the previous case, the introduction of log 102 in channel 106 is effected by pusher 112. It pushes log 102 against a web 108 fed by belts 105 towards means for packaging 123. The web 108 is thus dragged by log 102 in channel 106 up to freeing it from belts 105.

To avoid that the free portions of the web 108 can follow undesired paths and can affect the correct packaging of log 102, in this case vertical guides 140 are provided arranged between the belts 105 and the plates 113. In particular, the guides 140 are associated to a vacuum system in order to cause the suction of the web 108 through holes 141 and to keep it adhesive to their surface. This technical solution achieves a rate of precision still higher than the case described with reference to figures from 1 to 9.

Figure 14:
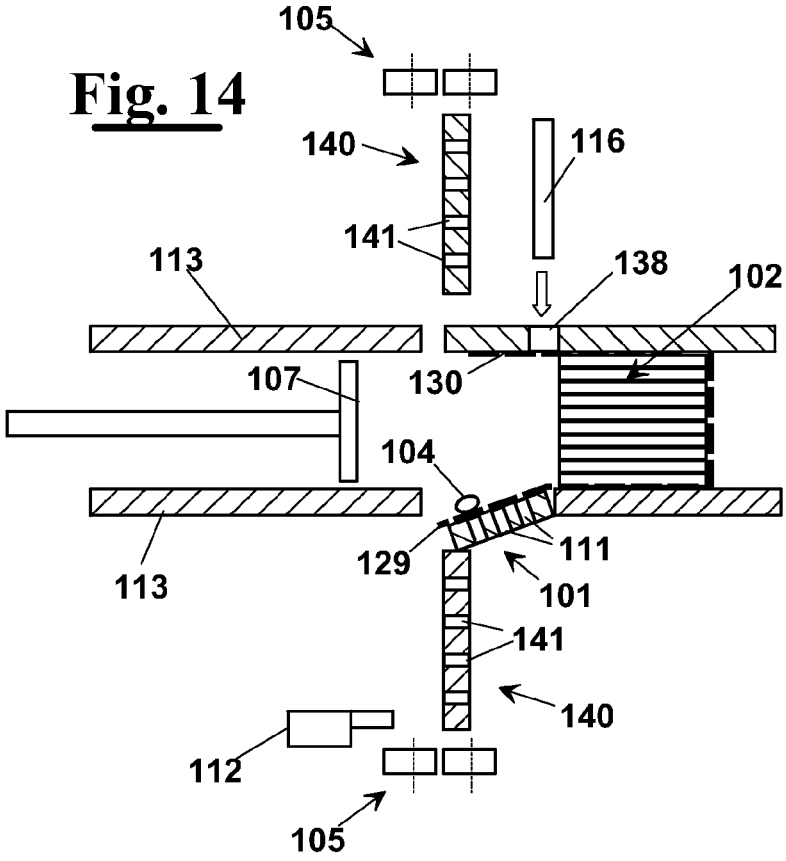
Figure 15:
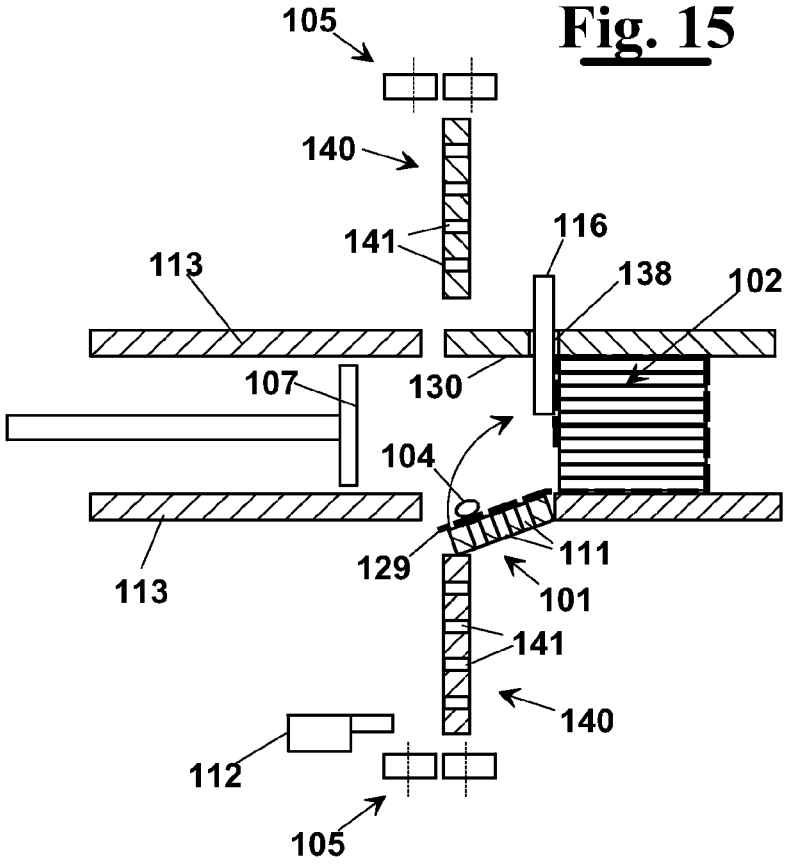
Figure 16:
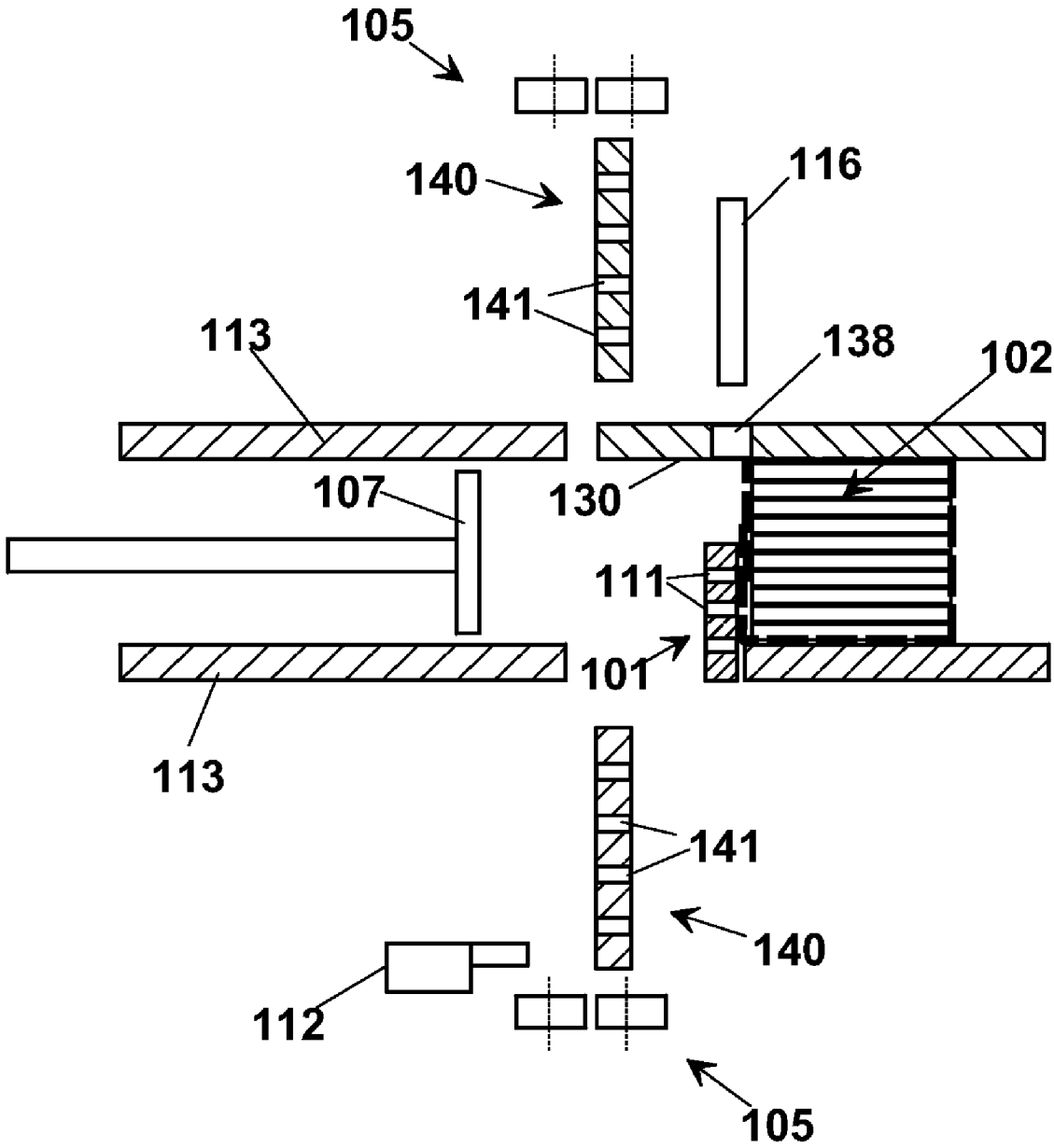

Once log 102 reaches the second section, the plate 101 rotates as indicated by arrow 114 allowing the motion of the web 108 having a glue line 104. In particular, the plate 101 has suction holes 111 in order to keep always adhesive the free wing 129 to its surface, as it occurs for vertical guides 140. This way it is possible to allow the withdrawal of pusher 112 without that this is dirtied of glue, as shown in FIG. 14.

In a way similar to the solution previously described, the lowering of the sheet laying member 116 blocks the free wing 130 on log 102. Then, a rotation of the plate 101 opposite to the previous one blocks the free wing 129 having the glue line 104 on log 102 completing the packaging.

Obviously, this alternative solution is only one of the possible solutions to the inventive concept. In fact exactly a specular solution can be used and i.e. causing the rotation of the upper plate of the withdrawn section, positioning in the upper part the glue gun. Furthermore, it is possible to couple to this alternative solution the piston 17 of the preferred configuration and described in FIG. 8. This way a back stroke rotation of plate 101 would be avoided causing the closure of the wing by said piston in a way already described. Furthermore, the plate 101, having in this case only the function of increasing the passage gap, can be of a much more limited length leaving to said piston all the functions already described of closing the wing with glue on the log.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Banding machine for banding a log of sheet material with a packaging sheet comprising:

a packaging channel, comprising first and a second consecutive sections, a narrow gap being present between said first and second sections;

pushing means constructed and arranged to convey a compressed log in said channel, the log under the action of said pushing means entering said first section and then running in said second section up to a predetermined depth;

means for arranging a packaging web for the log between said first and said second sections running through said gap, whereby said web wraps the log on three sides moving in said channel from said first to said second section, and a glue distribution system adapted to spread on said web a line of glue in a predetermined glued zone, said glued zone running through said gap when said web wraps on said log;

wherein at least one of said first and said second sections comprises a movable portion for enlarging said gap for the movement of said glued zone of said web, and wherein said movable portion for enlarging said gap is arranged between said glue distribution system and said packaging channel.

2. Banding machine according to claim 1, wherein said channel comprises:

at least two lower plates adjacent to and distanced by said gap, said lower plates being located one in a front position and one in a rear position with respect to each other in a manner suitable to form a sliding plane for the log, and at least two upper plates adjacent to and distanced by said gap, one located in a front position and one in a rear position with respect to each other and in a manner suitable to form a upper plane for containing the log, wherein said first section comprises said front plates and said second section comprises said rear plates, at least one of said plates of said sections being movable for enlarging said gap.

3. Banding machine according to claim 2, wherein said rear lower plate is movable for enlarging said gap.

4. Banding machine according to claim 2, wherein said front lower plate is movable for enlarging said gap.

5. Banding machine according to claim 4, wherein said front plate of said lower plates is rotatable in order to increase gap size of passage for a web of paper with glue spread along a line thereof in its lower part.

6. Banding machine according to claim 4, wherein said rear plate of said lower plates is rotatable in order to increase gap size of passage for web a of paper with glue spread along a line in its lower part.

7. Banding machine according to claim 1, wherein said means for arranging a packaging web comprises at least two pairs of pulling belts, of which one pair located is in a position higher than said upper plates and one pair is located in a position lower than said lower plates, allowing thereby the sheet located in said gap to be laid along all the width of the machine to allow then banding of the log.

8. Banding machine according to claim 7, wherein between said pairs of belts and said channel, vertical guides are provided constructed and arranged to bring said web towards said means for packaging, said guide having suction holes connected to a vacuum system, adapted to keep the web adhered to the surface of said guide.

9. Banding machine according to claim 8, wherein said lower plate has vacuum suction holes connected to a vacuum system, and wherein said portion of lower plate is associated with means for lowering below the level of the lower plates for allowing a back stroke of said pusher without contamination of the pusher with glue spread on the web.

10. Banding machine according to claim 7, wherein said means adapted to packaging the log comprises at least one system of glue distribution adapted to spread an amount of glue along a line of the web of paper and located in a position between said plates and said belts, said means for distribution of the glue along a line of the web of paper comprising a fixed glue gun located distanced between said pairs of lower pulling belts of said web and said plates.

11. Banding machine according to claim 1, wherein means are provided for closing free wings that are formed when the web wraps on the log, said means for closing comprising an upper sheet laying member having vertical movement located aligned with the log, adapted to stretch a first free wing of said web on the log.

12. Banding machine according to claim 1, wherein means are provided for closing two wings that are formed when the web wraps on the log, said means for closing comprising a movable portion of said lower plate located aligned with the log adapted to block one of the two wings, which is spread with glue, on the other of the two wings, which is not spread with glue.

* * * * *